United States Patent [19]

Tanaka et al.

[11] 4,326,112

[45] Apr. 20, 1982

[54] MICROWAVE OVEN HAVING A TUBULAR L-SHAPED ANTENNA

[75] Inventors: Junzo Tanaka, Fujiidera; Nobuo Ikeda; Hirofumi Yoshimura, both of Nara, all of Japan

[73] Assignee: Matsushita Electric Industrial Co., Ltd., Kadoma, Japan

[21] Appl. No.: 96,169

[22] Filed: Nov. 20, 1979

Related U.S. Application Data

[63] Continuation of Ser. No. 893,306, Apr. 4, 1978, abandoned.

[30] Foreign Application Priority Data

Oct. 14, 1977 [JP] Japan ..... 52-123761
Oct. 17, 1977 [JP] Japan ..... 52-124741

[51] Int. Cl.[3] ..... H05B 6/72
[52] U.S. Cl. ..... 219/10.55 F; 219/10.55 R
[58] Field of Search ..... 219/10.55 F, 10.55 R, 219/10.55 A, 10.55 E

[56] References Cited

U.S. PATENT DOCUMENTS

| | | | |
|---|---|---|---|
| 3,172,987 | 3/1965 | Fitzmayer | 219/10.55 F |
| 3,265,780 | 8/1966 | Long | 219/10.55 F |
| 3,526,737 | 9/1970 | Black | 219/10.55 F |
| 3,823,295 | 7/1974 | Simon et al. | 219/10.55 F |
| 3,878,350 | 4/1975 | Takagi | 219/10.55 E |
| 4,028,520 | 6/1977 | Torrey | 219/10.55 F |

FOREIGN PATENT DOCUMENTS

| | | | |
|---|---|---|---|
| 2622173 | 12/1976 | Fed. Rep. of Germany | 219/10.55 F |
| 52-41939 | 3/1977 | Japan | 219/10.55 F |
| 374781 | 1/1964 | Switzerland | 219/10.55 F |

OTHER PUBLICATIONS

Radiation, "Fields and Waves in Communication Electronics", pp. 646–651, Ramo et al., 1965.

*Primary Examiner*—B. A. Reynolds
*Assistant Examiner*—Philip H. Leung
*Attorney, Agent, or Firm*—Wenderoth, Lind & Ponack

[57] ABSTRACT

The present invention is a microwave oven having a rotary antenna with a substantially tubular L-shaped configuration from which microwaves are radiated into a heating cavity. This antenna is constituted by a first antenna portion, which extends from and is perpendicularly to a wall of the heating cavity in the microwave oven and has a length substantially equal to a quarter of the wavelength, and a second antenna portion which extends parallel to the wall and has a length substantially equal to half the wavelength so as to distribute the microwaves evenly inside the heating cavity.

5 Claims, 5 Drawing Figures

MICROWAVE OVEN HAVING A TUBULAR L-SHAPED ANTENNA

This is a continuation of application Ser. No. 893,306 filed Apr. 4, 1978, now abandoned.

The present invention generally relates to a microwave oven and, more particularly, to a microwave oven of a type having a microwave antenna with a substantially tubular L-shaped configuration for radiating microwaves therefrom.

Heretofore, there have been proposed various types of antennas to be incorporated in microwave ovens for radiating microwaves therefrom to establish an even distribution of microwave energy within the heating cavity. These types of antennas are, for example, disclosed in U.S. Pat. No. 2,961,520, U.S. Pat. No. 3,436,507, U.S. Pat. No. 3,643,055 and U.S. Pat. No. 4,028,521.

The microwave oven disclosed in the U.S. Pat. No. 2,961,520 employs a rotating antenna having respective arms with lengths substantially equal to a quarter of the wavelength and half the wavelength. This antenna is positioned under a material, for example, a food item, to be heated and is rotated in a plane parallel to the bottom of the heating cavity. Therefore, the microwaves are radiated mainly in a direction perpendicular to the antenna and there is virtually no radiation of microwaves in a direction parallel to the antenna.

On the other hand, the microwave oven disclosed in the U.S. Pat. No. 4,028,521 has a rotating antenna which has a somewhat L-shaped configuration having a straight shank portion connected to and aligned with the drive shaft of a rotating means and a radially extending arm portion which is arranged substantially perpendicular to the shank. Since the straight shank portion is positioned inside a wall enclosing the heating cavity, only the arm portion is disposed in the heating cavity to radiate microwaves therefrom. Thus microwaves are radiated mainly in a direction perpendicular to the arm portion.

Furthermore, both of the microwave ovens described above have the antenna arranged on a bottom wall of the heating cavity, that is, below the food item to be heated. Accordingly, the microwaves radiated from the antenna are hindered by a food item supporting means, such as a grid-type shelf, which is usually made of metal. Not only does such an arrangement adversely affect the pattern of distribution of microwaves, but it causes a loss of microwave energy because the shelf absorbs it. As a result, the food item is not sufficiently heated while the shelf is undesirably heated to such an extent that the portion of the food item in contact with the shelf is browned or scorched.

Moreover, water or juice produced from the food item during the heating thereof may collect on the bottom wall and possibly around the antenna. This may result in a spark discharge between the antenna and the matter disposed around the antenna unless a suitable drain or the like is employed to keep such water or juice away from the antenna.

Accordingly, a primary object of the present invention is to provide a microwave oven with a tubular rotary antenna capable of radiating microwaves in two directions, namely, parallel to the axis of rotation of the antenna and perpendicular to the axis of rotation.

Another important object of the present invention is to provide a microwave oven with an antenna of the above described type capable of radiating microwaves evenly inside the heating cavity.

Yet another object of the present invention is to provide a microwave oven with an antenna of the above described type arranged at a position remote from the bottom wall to substantially eliminate the possibility of water or juice falling onto the antenna.

A further object of the present invention is to provide a microwave oven with an antenna of the above described type and with an electric heating unit which will not disturb the distribution of the microwaves.

A still further object of the present invention is to provide a microwave oven with an antenna of the above described type which can withstand the temperature in the heating cavity.

A still further object of the present invention is to provide a microwave oven with an antenna of the above described type which is simple in construction and can be readily manufactured at low cost.

In order to accomplish these and other objects of the present invention, the microwave oven according to the present invention comprises a magnetron for generating microwaves, a waveguide having one end connected to the magnetron and the other end connected to the heating cavity of the oven for propagating microwaves from the magnetron to the heating cavity, and an antenna with a substantially tubular L-shaped configuration having a first antenna portion, which extends substantially perpendicular to the wall of the heating cavity where the other end of the waveguide terminates, and a second antenna portion which extends substantially parallel to that wall.

The first antenna portion is connected to a driving means for rotating the antenna in such a manner that the second antenna portion rotates in a plane perpendicular to the longitudinal axis of the first antenna portion. The first antenna portion projects from the wall a distance which is about a quarter of the wavelength and the second antenna portion has a length of about n times half the wavelength, n being an integer.

These and other objects and features of the present invention will become apparent from the following description of the preferred embodiments thereof with reference to the accompanying drawings, in which.

Before the description of the present invention proceeds, please note that like parts are designated by like reference numerals throughout the accompanying drawings.

Figure 1:
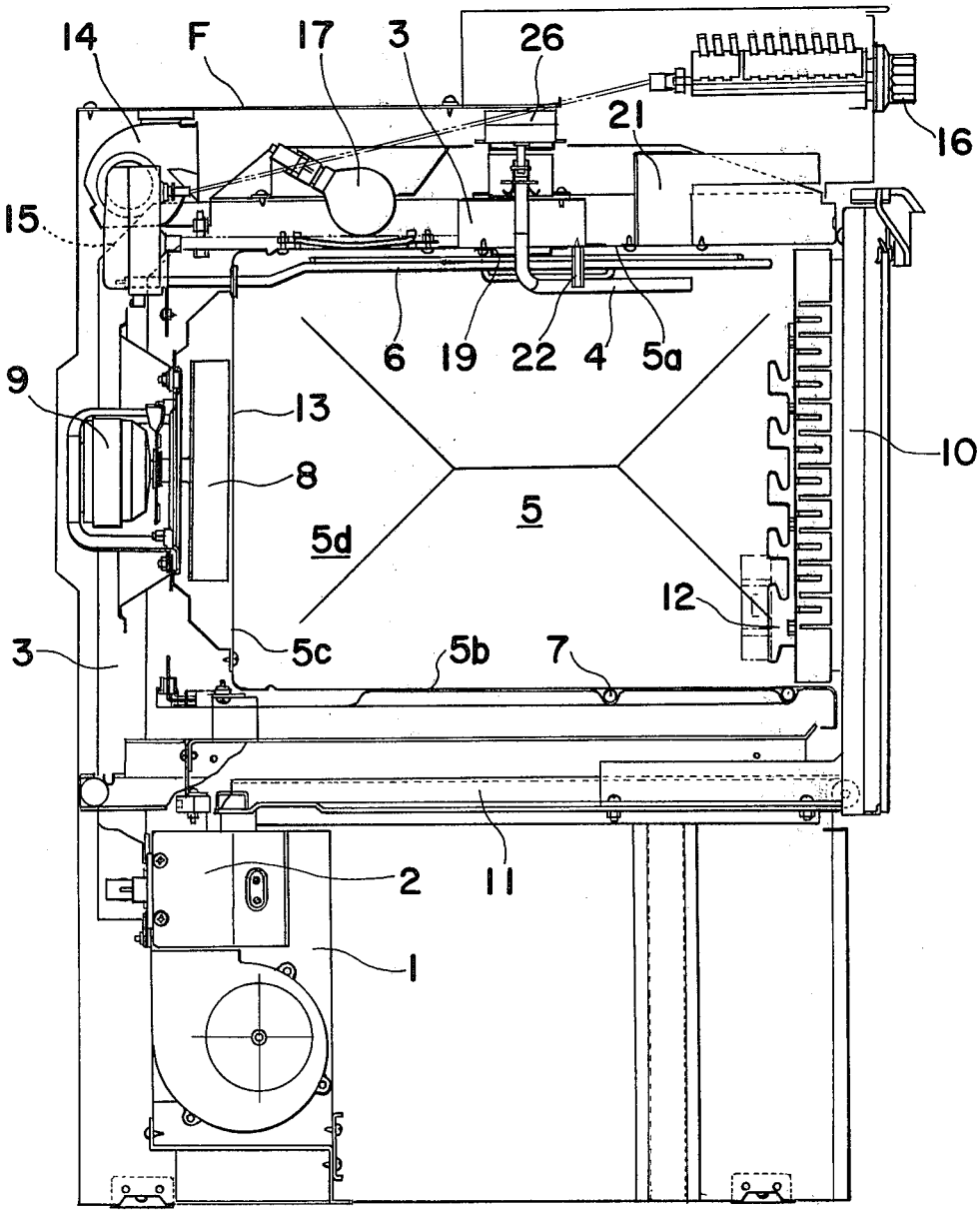
FIG. 1 is a side sectional view of a microwave oven according to a preferred embodiment of the present invention.
Figure 2:
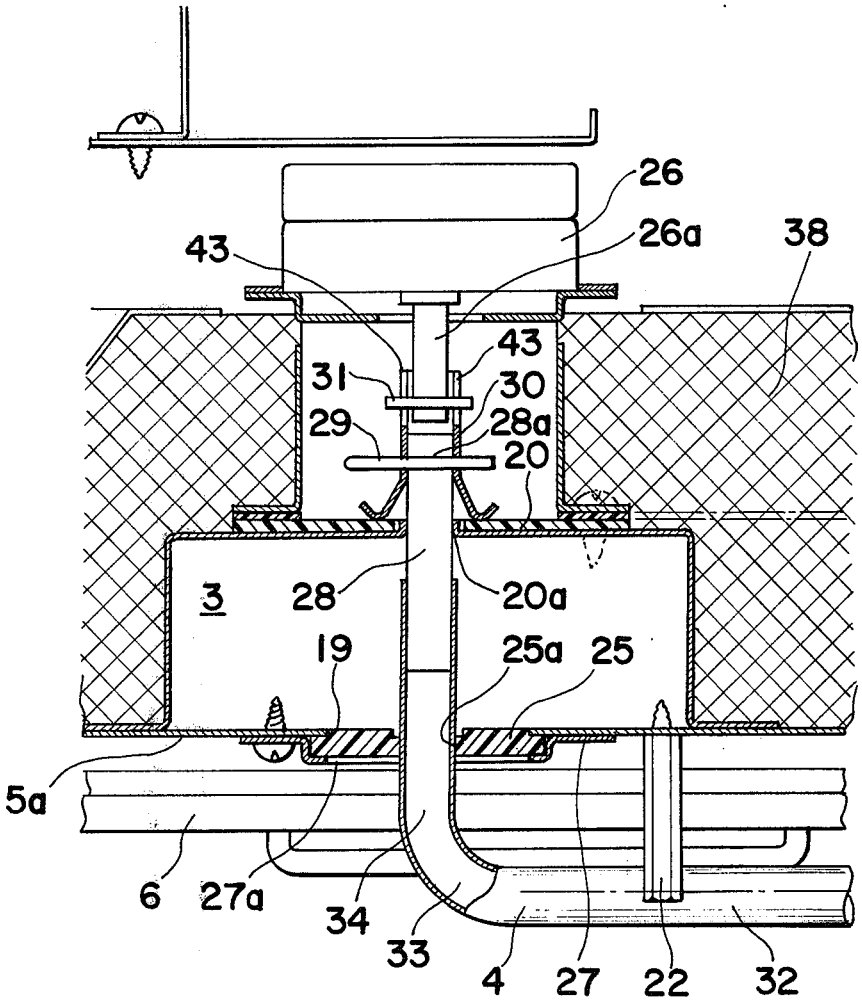
FIG. 2 is an enlarged detail view of the antenna coupled to the rotating means shown in FIG. 1.

Referring to FIG. 1, there is shown a side sectional view of a microwave oven embodying the present invention. The microwave oven has a framework F in which there is accommodated a heating cavity 5 of cubic shape. The heating cavity 5 is constituted by a top wall 5*a*, a bottom wall 5*b*, a rear wall 5*c* and side walls 5*d* (only one of the side walls is shown). The oven cavity 5 is closed by a door member 10 having a substantially L-shaped configuration which is so slidably mounted on a rail 11 provided under and adjacent to the bottom wall 5*b* that, when the door member 10 is pulled towards the right as viewed in FIG. 1, the oven cavity 5 is opened ready to receive material to be heated (not shown) into the heating cavity 5 and, when the door member 10 is pushed towards the left as viewed in FIG. 1, the cavity 5 is closed. Provided under the bottom wall 5*d* is a microwave generator 1 of any known construction including a magnetron 2 which is connected to a waveguide 3 extending upward behind the rear wall 5*c* and above the top wall 5*a* and terminating at approximately the center portion of the top wall 5*a*. The free end of the waveguide 3 remote from the magnetron 2 is connected to the heating cavity 5 through an opening 19, preferably having a circular configuration, formed in the top wall 5*a*, as best shown in FIG. 2. Thus microwaves are transmitted into the cavity 5 through the opening 19 by means of a tubular antenna 4 coaxially arranged in the opening 19. Although the depth of the opening 19, corresponding to the thickness of the top wall 5*a*, is comparatively small, this opening 19 constitutes a power supply opening, while the antenna 4 serves as an inner conductive element.

Before the description of the antenna 4 and its associated parts proceeds, various devices and elements disposed inside and outside the heating cavity 5 will now be described.

A plurality of hooks 12 aligned vertically along the inside surface of the door member 10 facing the heating cavity 5 are provided for the support of a shelf, particularly, a grid-type shelf (not shown).

Provided behind the heating cavity 5 is a fan 8 driven by a fan motor 9 which is supported by the framework F. Since the rear wall 5*c* has a number of perforations defined therein, the air flow generated by the fan 8 is directed into the heating cavity 5 through the perforations for circulation of the air inside the heating cavity 5. This air flow thoroughly mixes the heated air inside the heating cavity 5 and thus prevents uneven heating of the material to be heated, for example a food item, even if the latter is placed on a dish or the like.

A lamp 17 is provided above the heating cavity 5 for illuminating the heating cavity 5 through a transparent plate 18 installed over an opening formed in the top wall 5*a*.

In addition to heating by microwaves, the heating cavity can be heated by two electric heaters. One electric heater, referred to as grilling heater 6, is provided below and closely adjacent to the top wall 5*a*, while the other electric heater, referred to as an oven heater 7, is provided directly under the bottom wall 5*b*. Note that the grilling heater 6 in this embodiment is positioned above the horizontal antenna portion 32 (see FIG. 2).

In order to control the temperature inside the heating cavity 5, the electric heaters 6 and 7 as described above and the magnetron 2 generating the microwave are controlled by a temperature controlling device 15 which is coupled to a manipulatable dial 16 disposed on the front side of the oven. Upon turning the dial 16, the electric heaters 6 and 7 and the magnetron 2 are selectively operated at a rate of power for a period of time set by a timer means (not shown) incorporated in the temperature controlling device 15.

In order to prevent the heat inside the heating cavity 5 from being transmitted to the framework F, particularly, to the upper side of the framework F, a ventilation mechanism including a cross flow fan 14 is accommodated in the framework F at the upper rear side thereof for exhausting the heated air existing between the top wall 5*a* and the framework F. Other spaces between the walls of the heating cavity and the framework F are filled with glass wool 38 (see FIG. 2) or a similar thermal insulator.

A duct 21 having one end connected to the heating cavity 5 at the top wall 5*a* thereof and the other end connected to the framework F is provided for discharging smoke and/or vapor therethrough. A projection or stub 22 projects into the heating cavity 5 from the top wall 5*a* for controlling the distribution of the microwave energy inside the cavity for improving the efficiency of the emission of microwave energy from the antenna 4.

Referring now to FIG. 2, antenna 4 having a substantially tubular L-shaped configuration is constituted by a horizontal tubular antenna portion 32, which extends parallel to the top wall 5*a*, and a vertical tubular antenna portion 34 which extends perpendicular to the top wall 5*a* through the opening 19. A part of this portion 34 intrudes into the end portion of the waveguide 3. The horizontal antenna portion 32 and the vertical antenna portion 34 are integrally connected to each other by a corner portion 33. The free end of the vertical antenna portion 34 is connected, by means of brazing, to one end of a shaft 28 of low dielectric material such as aluminous porcelain. The other end of the shaft 28 is connected to a rotary shaft 26*a* of a motor 26 through a connecting means, described later, for rotating the antenna 4 about the shaft 28. Note that the projection 22 is so separated from the vertical antenna portion 34 that the rotation of the horizontal antenna portion 32 cannot be interrupted by the projection 22. The vertical antenna portion 34 is maintained in its position by an opening 25*a* formed at the center of a supporting plate 25 of low dielectric material, such as synthetic resin, tightly accommodated in the opening 19. The supporting plate 25 is tightly held in the position by a plate member 27 which is formed with an opening 27*a*. Since the edge of the opening 27*a* corresponds to the edge of the opening 19, these edges of the openings 19 and 27*a* serve as an outer conductive element. On the other hand, the shaft 28 is maintained in its position by an opening 20*a* formed in the upper wall of the end portion of the waveguide 3. Note that the openings 25*a* and 20*a* have diameters slightly larger than the diameters of the vertical antenna portion 34 and the shaft 28, respectively, so that the antenna 4 and the shaft 28 can freely rotate in the respective openings.

The connecting means which connects the shaft 28 and the shaft 26*a* of the motor 26 includes a cylindrical member 30 having a lower end portion outwardly enlarged in diameter and an upper end portion having a pair of opposite grooves 43 extending parallel to the axis of the shaft 28. An intermediate portion of the cylindrical member 30 has a pair of opposite openings for allowing a bar member 29 to extend transversely through the cylindrical member 30. The upper end portion of the shaft 20 has a bore 28*a* and is inserted into the cylindrical member 30. The bar member 29 retains the upper end portion of the shaft 20 in position within the cylindrical member 30 while it extends through the openings in the cylindrical member 30 by way of the bore 28*a*. The shaft 26*a* of the motor 26 is connected to, or otherwise integrally formed with, a crossing bar 31 at its projecting end portion for engagement with the grooves 43 formed in the cylindrical member 30.

With this arrangement as described above, the driving force of the motor 26 is transmitted, through its shaft 26*a*, to the cylindrical member 30 and then to the antenna 4 through the shaft 28. To facilitate the rotation of the cylindrical member 30, its enlarged end portion is bent upward while a plate member 20 of dielectric material serving also as a heat resisting material is placed between the upper wall of the waveguide 3 and the cylindrical member 30 for smooth movement of the cylindrical member 30 and also to prevent direct contact of the cylindrical member 30 with the waveguide 3.

As understood by those skilled in the art, the antenna 4 can be simply connected to the motor 26 by first inserting the vertical antenna portion 34 of the antenna 4 which is coupled to the shaft 28 into the openings 25*a* and 20*a*, then mounting the cylindrical member 30 from the top of the oven, and finally installing the motor 26 by inserting the shaft 26*a* into the cylindrical member 30. The length of the shaft 28 is arranged so that the distance between the horizontal antenna portion 32 and the top wall 5*a* is equal to one fourth of the wavelength of the microwave energy. On the other hand, the length of the horizontal antenna portion 32 is equal to n times half the wavelength, that is, n/2 of the wavelength of the microwave energy used, wherein n is an integer. Note that the vertical and horizontal antenna portions each serve as a dipole antenna.

Figure 3:
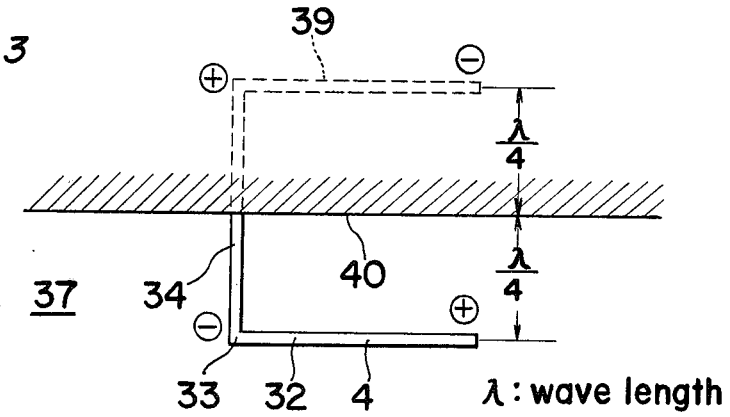
FIG. 3 is an explanatory view showing a principle of operation of the antenna shown in FIG. 1.

The reason for the employment of the substantially L-shaped antenna 4 will now be described with particular reference to FIG. 3. In FIG. 3, for the purpose of description, the antenna 4 is shown as having a vertical portion 34 projecting into a space 37 from a microwave reflective surface 40 in a direction perpendicular to the plane of the surface 40, and a horizontal portion 32 extending within the space 37 parallel relation to the plane of the reflective surface 40 and spaced from the latter a distance equal to a quarter wavelength.

Assuming now that the antenna 4 is coupled to a microwave source, the microwaves so supplied to the antenna 4 propagate in part from the vertical portion 34 in a radial direction substantially at right angles to the longitudinal axis of this portion 34 and in part from the horizontal portion 32 in a radial direction substantially at right angles to the longitudinal axis of this portion 32. The microwaves propagating from the horizontal portion 32 in a direction towards the surface 40, after impinging upon the reflective surface 40, are reflected towards the surface 37 as if the reflected microwaves had come from an imaginary antenna 39 located at a position symmetrical to antenna 4 with respect to the plane of the reflective surface 40.

The microwaves reflected from the reflective surface 40 and propagating into the space 37 intermingle with the microwaves propagating from the same portion 32 towards the space 37 without being reflected by the reflective surface 40. Since the position of the imaginary antenna 39 is spaced from the position of the horizontally extending portion 32 a distance equal to half the wavelength, the intermingling of the reflected microwaves and the non-reflected microwave both propagating in the same direction towards the space 37 results in amplification of the microwaves as a whole with the microwave energy consequently doubled.

Applying the foregoing description to the embodiment described above, since the reflective surface 40 shown in FIG. 3 functionally corresponds to the top wall 5*a*, it is clear that the employment of the substantially L-shaped antenna is advantageous in facilitating efficient heating within the heating cavity.

Although the corner portion 33 of the antenna 4 is shown as 90° joint, it needs not always be limited thereto, but may be curved as illustrated in FIG. 2 if the requirement described with reference to FIG. 3 can be fulfilled.

Figure 4:
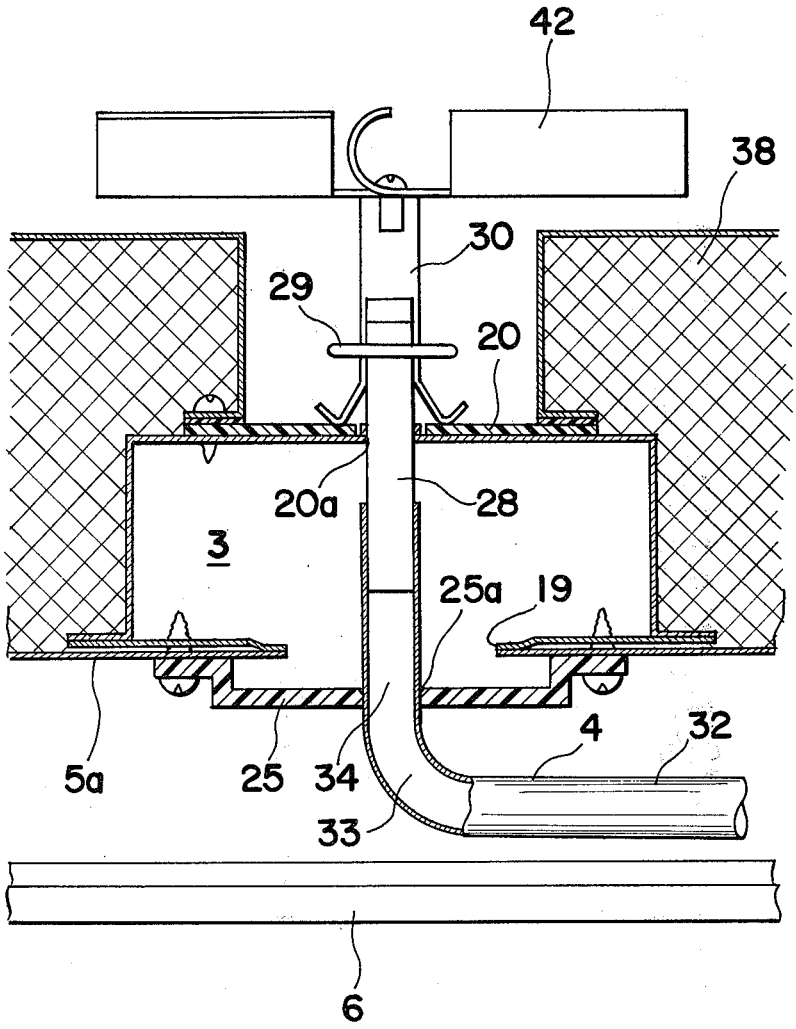
FIG. 4 is an enlarged detail view similar to FIG. 2, but particularly showing a modification thereof.

Referring to FIG. 4, there is shown another embodiment of the present invention. According to this embodiment, the supporting plate 25, which has been described as accommodated in the opening 19 in the foregoing embodiment, is provided under the opening 19 and is directly secured to the top wall 5*a* together with the waveguide 3 by a suitable securing means for improving the insulation between the inner conductive element and the outer conductive element, that is, between the vertical antenna portion 34 and the edge of the opening 19. With the arrangement as described above, it is no longer necessary to position the supporting plate 25 between the inner and outer conductive elements where the highest energy of the electric field is established. Therefore, the loss of microwave energy therebetween, particularly, at the outer conductive element, is comparatively small and there is a reduced possibility of forming a spark discharge caused by smears of oil or foodstuffs sticking to the supporting member 25. Furthermore, by coating the antenna 4 with an insulating material such as anodized aluminum, the possibility of producing the spark discharge is further reduced.

In the case where the walls constituting the heating cavity 5 are finished with an enamel coating, the edge of the opening 19 constituting the outer conductive element shold not be coated with the enamel.

Still referring to FIG. 4, in this embodiment, the motor 26, which has been described as rotating the antenna in the foregoing embodiment, is replaced by an impeller 42 which is connected to the cylinder member 30 and rotates the antenna 4 by the flow of air generated by the cross flow fan 14. This arrangement has an advantage in reducing the manufacturing cost.

The grilling heating 6 in this embodiment is shown as positioned below the horizontal antenna portion 32, whereas the same is shown as positioned above the horizontal portion 32 in the previous embodiment of FIGS. 1 and 2. This variation in position does not make much difference in the distribution of the microwaves, however, by positioning the grilling heater 6 below the horizontal antenna portion 32, one or both of the antenna 4 and the supporting member 25 can be prevented from being soiled with oil and foodstuffs and also from being accidentally touched by the user.

The microwave oven of the present invention as described above has advantages and features as listed below.

(1) The microwaves radiated from the rotating antenna 4 are distributed evenly in the heating cavity 5 and the energy thereof is doubled by the microwaves reflected from the top wall 5*a*.

(2) Since the antenna 4 is of rigid construction, it has a higher physical strength than that of a stirrer employed in the conventional microwave oven and the possibility of damaging the antenna by contact with a foodstuffs or the like is minimized. Therefore, the antenna 4 can be disposed directly in the heating cavity 5.

(3) Since the antenna 4, particularly, the horizontal antenna portion 32, is in the form of a tubular rod, this portion 32 does not hinder the radiation of heat from the grilling heater 6, provided that the heater 6 is positioned above the horizontal antenna portion 32. Therefore, the heat radiated from the heater 6 can be transmitted to the object to be heated with no substantial loss thereof and the microwaves radiated from the antenna 4 can also be transmitted to the object with no substantial loss thereof. Therefore in the microwave oven according to the present invention heating by the use of microwave energy and an electric heater unit can be performed simultaneously.

(4) Since the antenna 4, particularly, the vertical antenna portion 34, is secured by two supporting means, that is, supporting plate 25 and a portion of the waveguide 3 where the opening 20*a* is formed, there is little possibility of misalignment of the antenna 4. Moreover, since the inner diameter of the cylindrical member 30 is much larger than the outer diameter of the shaft 26*a* of the motor 26, the shaft 26*a* can be simply inserted into the cylindrical member 30. Even if the axis of the shaft 26*a* deviates from the axis of the vertical antenna portion 34, the antenna 4 may be smoothly rotated because of the two supporting means. Similarly, in the case where the antenna 4 is rotated by the impeller 42, the smooth rotation of the antenna 4 can be ensured, even if the flow of air directed to the impeller 42 should vary. Therefore, a constant distribution of microwaves can be obtained.

(5) The flow of air generated by the cross flow fan 14 prevents the motor 26 or impeller 42 from being undesirably heated.

(6) The antenna 4 can be simply accommodated in position and can be simply connected to the motor 26 or impeller 42 by the connecting means including the cylindrical member 30.

(7) By coating the antenna 4 with an insulating material such as alumina, spark discharges are not produced from the antenna 4 even in the presence of smears of oil and foodstuff around the antenna 4 or even when the oven is operated with no material to be heated present within the heating cavity.

(8) By positioning the supporting plate 25 away from the space between the inner and outer conductive elements, the insulation therebetween is improved. Therefore, a spark discharge is hardly ever established therebetween.

(9) By constructing the power supply opening 19 at approximately the center of the top wall 5*a*, a freedom of choice of the length of the horizontal antenna portion 32 is avilable and, at the same time, the microwaves can be distributed evenly. Furthermore, the resonance mode of the heating cavity 5 can be easily excited by the vertical antenna portion 34.

Figure 5:
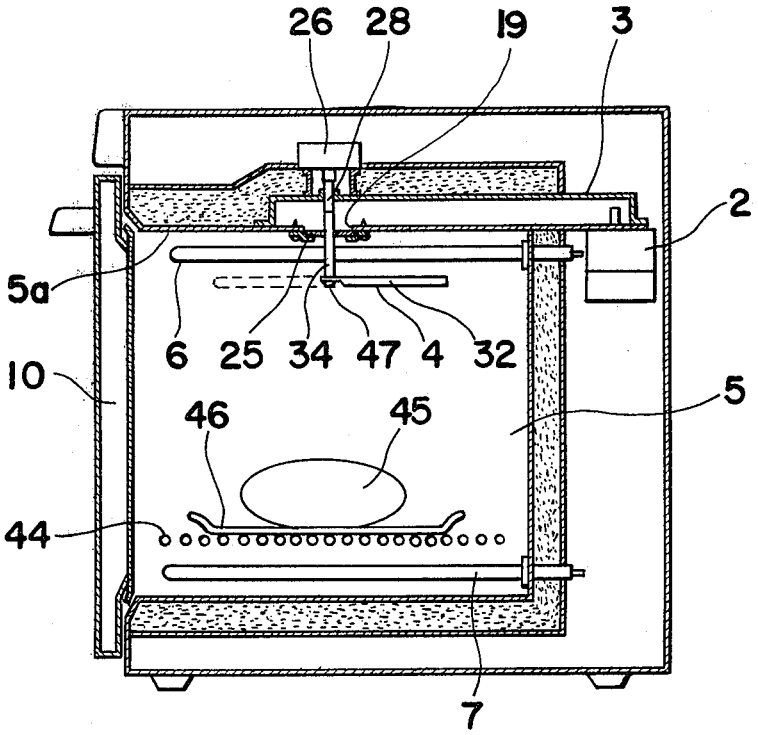
FIG. 5 is a view similar to FIG. 1, showing a microwave oven according to another preferred embodiment of the present invention.

Referring to FIG. 5, there is shown a further embodiment of a microwave oven of the present invention, in which an object to be heated, such as foodstuff 45, is placed on a container or tray 46 which is placed on a grid-type shelf 44 supported by a supporting means (not shown). When the heating cavity 5 is heated merely by the two electric heaters 6 and 7, the temperature inside the heating cavity 5 will increase to a maximum of approximately 250° C. In order to prevent the grid-type shelf 44 from deteriorating or deforming by this high temperature, the shelf 44 is usually constructed of metallic rods connected to each other in the form of a lattice. If the microwave oven is so constructed as to radiate microwaves from below the shelf 44, some of the radiated microwaves may be captured by the grid-type shelf 44 to reduce the energy of the microwaves above the shelf 44, on which the objects to be heated are usually placed, so that the microwaves may not sufficiently heat up the foodstuff and may heat the metallic rods of the grid-type shelf to cause undesirable scorches on the foodstuff.

However, according to the present invention, the antenna 4 radiating the microwaves is positioned further away from the grid-type shelf 44 than from the foodstuff 45, in other words, the antenna 4 is positioned directly above the foodstuff 45 without any hindrance therebetween, so that the full power of the microwave source can be applied to the foodstuff 45 and no such scorches will be formed which otherwise would be formed upon heating of the shelf 44.

According to the present invention, since the antenna 4 is provided on the top wall 5*a*, there is no need to form a drain or the like to guide water or sauce spilt from the container or water condensed from vapor from the bottom wall 5*b*. Therefore, it is easy to clean the bottom wall 5*b*.

Although the present invention has been fully described by way of examples with reference to the accompanying drawings, note that various changes and modifications are apparent to those skilled in the art. For example, the vertical and horizontal portions of the antenna 4 can be formed separately and connected to each other by the use of a suitable connecting means, such as fastening screw 47 as shown in FIG. 5. Therefore, unless such changes and modifications depart from the true scope of the present invention, they should be construed as included therein.

What is claimed is:

1. A microwave oven comprising:

conductive walls and a conductive door defining an enclosed heating cavity, one of said walls having an opening defined therein and serving as an outer conductive element for microwaves;

means for generating microwaves;

a waveguide having one end coupled to said generating means and the other end coupled to said opening in said one of the walls, said waveguide having a first hole therein opposite said opening, for supplying said microwaves from said generating means towards said opening in said one of the walls;

an antenna of a substantially tubular L-shaped configuration and serving as an inner conductive element for said microwaves, said antenna being constituted by a first tubular antenna portion, having one end disposed in said waveguide means and extending through said opening in said one of the walls in a direction perpendicular to the plane of said one of the walls, and a second tubular antenna portion radially extending from said first antenna portion and positioned within said heating cavity, said second antenna portion having its longitudinal axis parallel to and spaced from said one of the walls a distance equal to a quarter of the wavelength of the microwaves, whereby microwaves are radiated in part from said first antenna portion in a direction substantially at right angles to the longitudinal axis of said first antenna portion and in part from said second antenna portion in a direction substantially at right angles to the longitudinal axis of said second antenna portion;

a driving means for rotating said antenna including an elongated connecting member of a low loss dielectric material having a diameter not greater than the diameter of said first antenna portion, connected at one end thereof to said first antenna portion, passing through and rotatably supported by said first hole in said waveguide, whereby said second antenna portion rotates in a plane perpendicular to the axis of said first antenna portion; and a supporting means of a dielectric material having a substantially convex downward shape and further having a second hole in the central portion thereof and being attached to said one of the walls at a point spaced outwardly from the edge of said opening and disposed in a position covering said opening in said one of the walls, and further having said first antenna portion passing through said second hole therein and rotatably supporting said first antenna portion.

2. A microwave oven as claimed in claim 1, wherein the length of said second antenna portion is substantially equal to n times half the wavelength, wherein n is an integer.

3. A microwave oven as claimed in claim 1, wherein said opening is formed at an approximate center of said one of the walls.

4. A microwave oven as claimed in claim 1 wherein said elongated connecting member and the first antenna portion are brazed to each other.

5. A microwave oven as claimed in claim 1 further comprising:

a ventilation mechanism for generating a flow of air for removing heat from said microwave oven; and wherein said driving means comprises a fan disposed in a position whereby said flow of air rotates said driving means.

* * * * *